US009281579B2

(12) United States Patent
Davis et al.

(10) Patent No.: US 9,281,579 B2
(45) Date of Patent: Mar. 8, 2016

(54) ELECTRICAL CONNECTORS HAVING LEADFRAMES

(71) Applicant: Tyco Electronics Corporation, Berwyn, PA (US)

(72) Inventors: Wayne Samuel Davis, Harrisburg, PA (US); James Myoungsoo Jeon, Harrisburg, PA (US); Chad W. Morgan, Carneys Point, NJ (US)

(73) Assignee: Tyco Electronics Corporation, Berwyn, PA (US)

( * ) Notice: Subject to any disclaimer, the term of this patent is extended or adjusted under 35 U.S.C. 154(b) by 7 days.

(21) Appl. No.: 14/276,864

(22) Filed: May 13, 2014

(65) Prior Publication Data

US 2015/0333420 A1 Nov. 19, 2015

(51) Int. Cl.
*H01R 13/648* (2006.01)
*H01R 9/24* (2006.01)

(52) U.S. Cl.
CPC ..... *H01R 9/24* (2013.01)

(58) Field of Classification Search
CPC ..... H01R 13/65802; H01R 13/658; H01R 13/506; H01R 23/6873; H01R 23/7073; H01R 23/005; H01R 13/514
USPC ..... 439/607.01, 607.02–607.07, 712
See application file for complete search history.

(56) References Cited

U.S. PATENT DOCUMENTS 5,795,191 A 8/1998 Preputnick et al.
6,146,202 A * 11/2000 Ramey et al. ..... 439/607.1
6,231,391 B1 * 5/2001 Ramey et al. ..... 439/607.07
6,371,813 B2 * 4/2002 Ramey et al. ..... 439/607.05
6,776,649 B2 * 8/2004 Pape et al. ..... 439/485
6,899,548 B2 * 5/2005 Houtz ..... 439/71
7,320,621 B2 * 1/2008 Laurx et al. ..... 439/607.11
7,758,357 B2 * 7/2010 Pan et al. ..... 439/108
7,789,708 B2 * 9/2010 Laurx et al. ..... 439/108
7,798,852 B2 * 9/2010 Laurx et al. ..... 439/607.08
7,819,697 B2 * 10/2010 Glover et al. ..... 439/607.07
7,905,751 B1 3/2011 Davis
7,927,143 B2 * 4/2011 Helster et al. ..... 439/607.05
8,262,412 B1 * 9/2012 Minnick et al. ..... 439/607.01
8,366,485 B2 * 2/2013 Johnescu et al. ..... 439/607.07
2009/0186533 A1 7/2009 Tokunaga

FOREIGN PATENT DOCUMENTS

WO 2006/105484 10/2006

OTHER PUBLICATIONS

European Search Report dated Oct. 8, 2015 received in counterpart EP Application No. 15167280.5.

* cited by examiner

*Primary Examiner* — Abdullah Riyami
*Assistant Examiner* — Vladimir Imas

(57) ABSTRACT

An electrical connector includes a contact module having a leadframe and a dielectric frame surrounding the leadframe. The leadframe has signal conductors having transition contacts encased in the dielectric frame. The transition contacts are coplanar such that the transition contacts are arranged within a contact plane of the leadframe. The signal conductors have mating contacts extending from the corresponding transition contacts. Each of the mating contacts have a mating interface configured to be electrically connected to a corresponding mating contact of a mating connector. The mating contacts are arranged in pairs with the corresponding mating interfaces aligned in rows along corresponding row axes. Each of the pairs of mating contacts are arranged in different rows.

20 Claims, 9 Drawing Sheets

ELECTRICAL CONNECTORS HAVING LEADFRAMES

BACKGROUND OF THE INVENTION

The subject matter herein relates generally to electrical connectors having leadframes.

Electrical systems, such as those used in networking and telecommunication systems, utilize electrical connectors to interconnect components of the system, such as a motherboard and daughtercard. However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some known systems utilize shielding to reduce interference between the contacts of the electrical connectors. Additionally, some known system use contacts that have redundant or multiple points of contact. Such contacts require a large amount of material when stamping and forming the contact. For some designs, using a single leadframe is impractical as the contacts are unable to be positioned close enough to each other. Such systems utilize two overmolded leadframes that are internested to form a single contact module. Such designs involve numerous pieces and are expensive and complicated.

A need remains for an electrical connector that may be manufactured in a cost effective and reliable manner.

BRIEF DESCRIPTION OF THE INVENTION

In one embodiment, an electrical connector is provided that includes a contact module including a leadframe and a dielectric frame surrounding the leadframe. The leadframe has signal conductors having transition contacts encased in the dielectric frame. The transition contacts are coplanar such that the transition contacts are arranged within a contact plane of the leadframe. The signal conductors have mating contacts extending from the corresponding transition contacts. Each of the mating contacts have a mating interface configured to be electrically connected to a corresponding mating contact of a mating connector. The mating contacts are arranged in pairs with the corresponding mating interfaces aligned in rows along corresponding row axes. Each of the pairs of mating contacts are arranged in different rows.

In another embodiment, an electrical connector is provided that includes a contact module having a stamped and formed leadframe and a unitary one piece dielectric frame surrounding a portion of the leadframe. The leadframe has signal conductors having transition contacts encased in the dielectric frame. The transition contacts are coplanar such that the transition contacts are arranged within a contact plane of the leadframe. The signal conductors have mating contacts extending from the corresponding transition contacts. Each of the mating contacts have a mating interface configured to be electrically connected to a corresponding mating contact of a mating connector. The mating contacts are arranged in pairs with the corresponding mating interfaces aligned in rows along corresponding row axes. Each of the pairs of mating contacts are arranged in different rows.

In another embodiment, an electrical connector is provided that includes a contact module having a single strip leadframe. The single strip leadframe has one or more pairs of signal conductors held by a common carrier. The signal conductors in each pair have a common length. Each of the signal conductors are vertically offset along a vertical axis of the common carrier. The signal conductors have transition contacts that are coplanar such that the transition contacts are arranged within a contact plane of the single strip leadframe. The signal conductors have mating contacts extending from corresponding transition contacts. Each of the mating contacts have a mating interface configured to be electrically connected to a corresponding mating contact of a mating connector. The mating contacts of each pair of signal conductors are vertically staggered along the vertical axis.

DETAILED DESCRIPTION OF THE INVENTION

Figure 1:
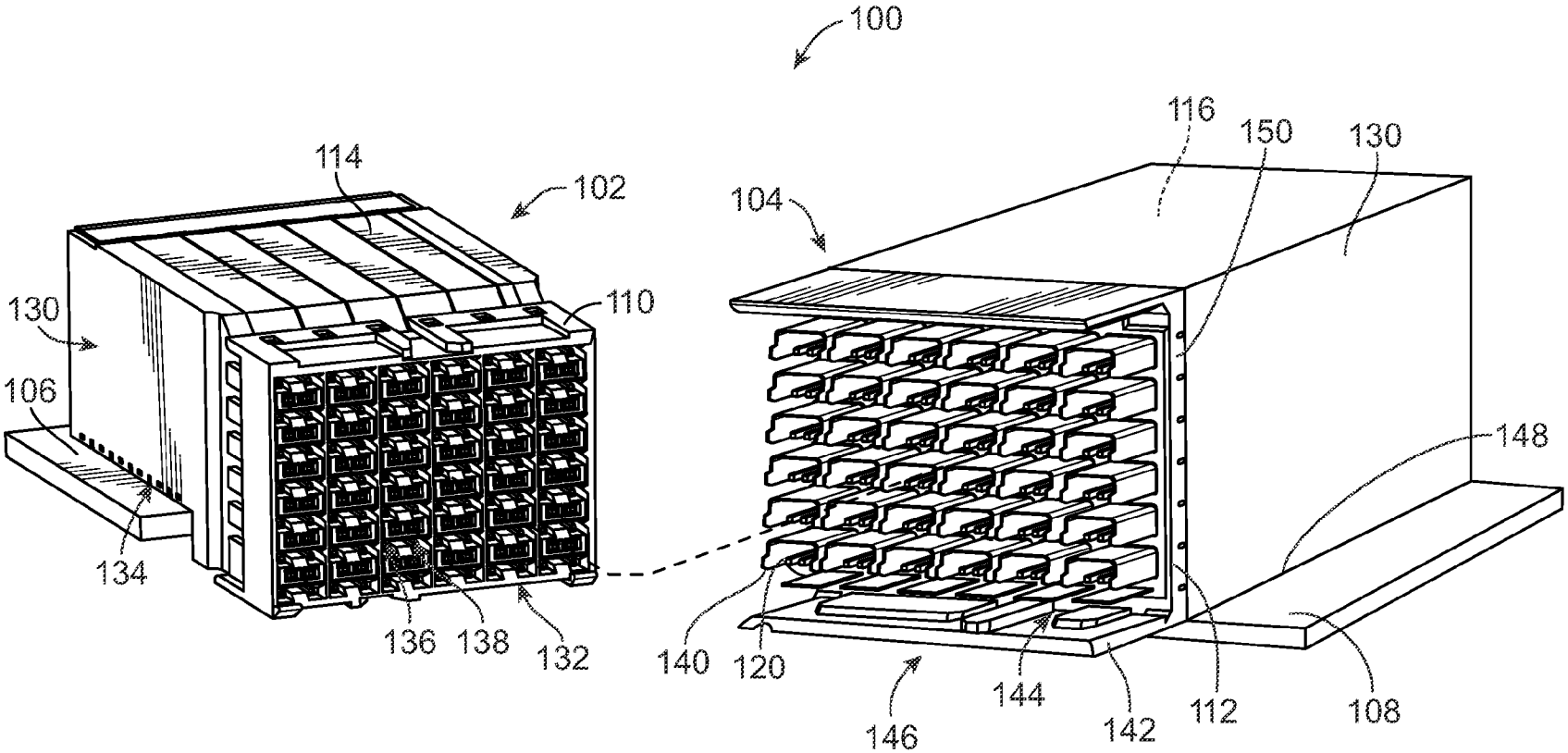
FIG. 1 is a perspective view of an electrical connector system illustrating an electrical connector and a mating connector in accordance with an embodiment.

FIG. 1 is a perspective view of an exemplary embodiment of an electrical connector system 100 illustrating electrical connectors 102 and 104 that may be directly mated together. In the illustrated embodiment, the first electrical connector 102 is a receptacle connector, and may be referred to hereinafter as a receptacle connector 102. In the illustrated embodiment, the second electrical connector 104 is a header connector 104 and may be referred to hereinafter as a header connector 104. The electrical connectors 102, 104 may be any type of connectors in alternative embodiments. The electrical connectors 102, 104 may be referred to individually as electrical connector or mating connector and may be referred to collectively as electrical connectors or mating connectors.

The receptacle and header connectors 102, 104 are each electrically connected to respective circuit boards 106, 108. The receptacle and header connectors 102, 104 are utilized to electrically connect the circuit boards 106, 108 to one another at a separable mating interface. In an exemplary embodiment, the circuit boards 106, 108 are oriented parallel to one another when the receptacle and header connectors 102, 104 are mated. Alternative orientations of the circuit boards 106, 108 are possible in alternative embodiments, such as an orthogonal or perpendicular orientation. In other alternative embodiments, either or both of the connectors 102, 104 may be cable connectors terminated to ends of cables rather than being board connectors terminated to the circuit boards 106, 108.

The receptacle and header connectors 102, 104 include front housing 110 and 112, respectively. The housing 110, 112 hold a plurality of contact modules 114, 116, respectively. Any number of contact modules 114, 116 may be provided to increase the density of the receptacle and header connectors 102, 104. The contact modules 114 in the receptacle connector 102 may be identical to one another, and the contact modules 116 in the header connector 104 may be identical to one another. The contact modules 114 are configured to be mated with corresponding contact modules 116. Alternatively, the receptacle and header connectors 102, 104 may be oriented such that each of the contact modules 114 is configured to be mated with each of the contact modules 116.

Figure 2:
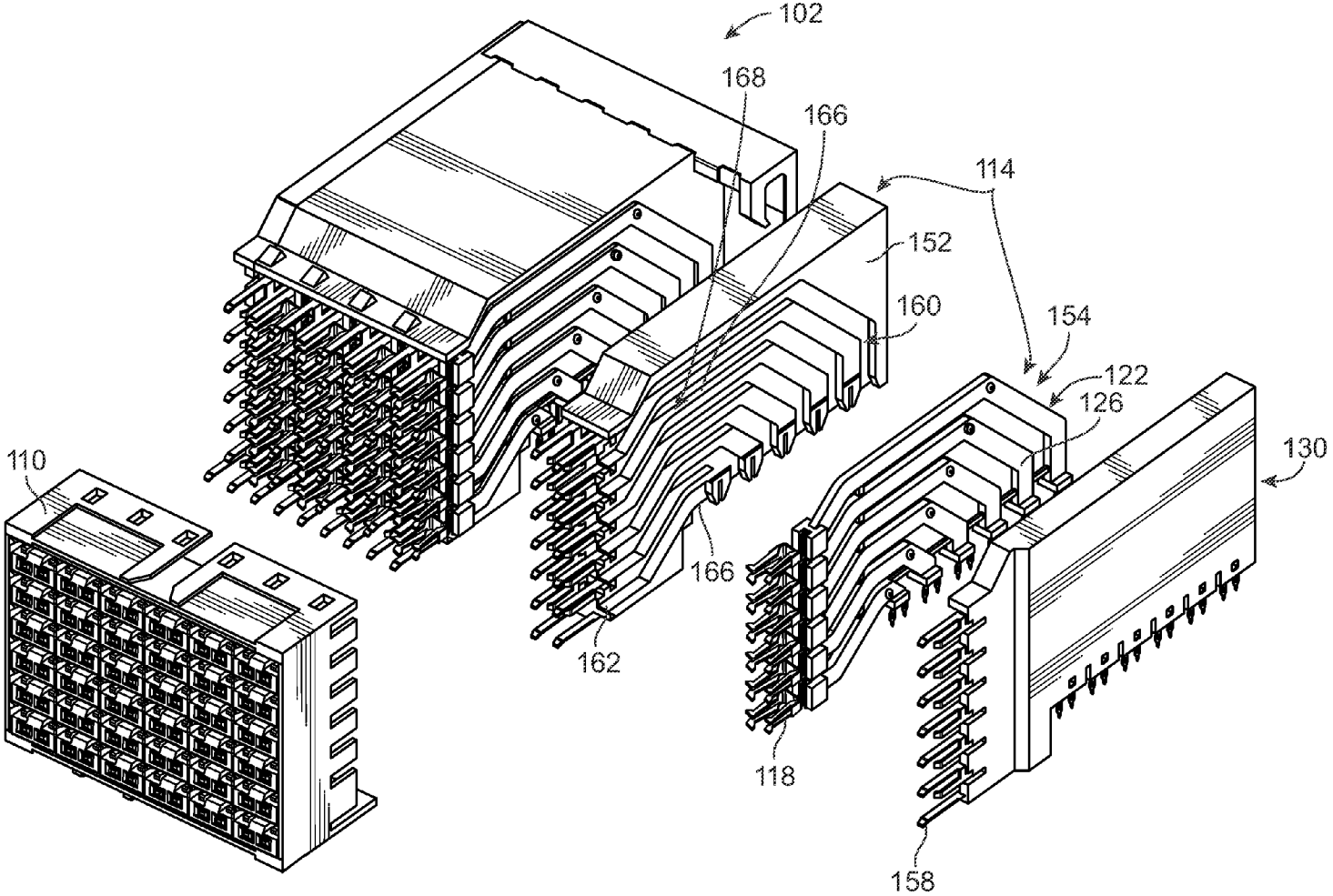
FIG. 2 is an exploded view of a receptacle connector with the housing removed showing various components of contact modules therein, according to an embodiment.

The contact modules 114 each include a plurality of receptacle signal conductors 118 (shown in FIG. 2). The contact module 116 includes a set of header signal conductors 120 (also shown in FIG. 6). The signal conductors 118, 120 may be arranged in pairs within the contact modules 114, 116 with the corresponding mating interfaces aligned in rows along correspond row axes 196 (shown in FIGS. 2 and 6) as discussed below. Each of the mating contacts may be arranged in different rows and may also be arranged as differential pairs such that the signal conductors 118, 120 carry complementary electrical signals. The signal conductors 118, 120 each include a leadframe 122, 124 (shown in FIGS. 2 and 6, respectively) surrounded by dielectric frames 126, 128 (shown in FIGS. 2 and 6, respectively). The leadframes 122, 124 are stamped and formed from a unitary body.

In an exemplary embodiment, each contact module 114, 116 has a shield structure 130 for providing electrical shielding for the signal conductors 118, 120. The shield structure 130 may include multiple components, electrically interconnected, which provide the electrical shielding. Optionally, the shield structure 130 may provide electrical shielding for differential pairs of the signal conductors 118, 120 to shield the differential pairs from one another. In alternative embodiments, the contact modules 114, 116 may be un-shielded.

The receptacle connector 102 includes a mating end 132 and a mounting end 134. In the illustrated embodiment, the mounting end 134 is substantially perpendicular to the mating end 132. However, in other embodiments, other arrangements are possible. For example, the mating end 132 may be substantially parallel to the mounting end 134. The receptacle signal conductors 118 (FIG. 2) are received in the front housing 112 and extend toward the mating end 132 for mating to the header connector 104. The receptacle signal conductors 118 are arranged in rows and columns at the mating end 132. Any number of receptacle signal conductors 118 may be provided in the rows and columns. In an exemplary embodiment, the pairs of receptacle signal conductors 118 are arranged in the same row at the mating end 132. The receptacle signal conductors 118 also extend to the mounting end 134 for mounting to the circuit board 106.

The front housing 110 is manufactured from a dielectric material, such as a plastic material. The front housing 110 is designed to hold the contact modules 114 in a stacked configuration. The front housing 110 includes a plurality of signal contact openings 136 and a plurality of ground contact openings 138 at the mating end 132. The receptacle signal conductors 118 are aligned with corresponding signal contact openings 136. The signal contact openings 136 receive corresponding header signal conductors 120 therein when the receptacle and header connectors 102, 104 are mated. The ground contact openings 138 receive header shields 140 therein when the receptacle and header connectors 102, 104 are mated.

The header connector 104 includes the header housing 112 having walls 142 defining a chamber 144. The header connector 104 has a mating end 146 and a mounting end 148 that is mounted to the circuit board 108. The receptacle connector 102 is received in the chamber 144 through the mating end 146. The front housing 110 of the receptacle connector 102 engages the walls 142 to hold the receptacle connector 102 in the chamber 144. The header signal conductors 120 and the header shields 140 extend from a base wall 150 into the chamber 144. The header signal conductors 120 and the header shields 140 extend through the base wall 150 and are exposed at the mounting end 148 for mounting to the circuit board 108.

In an exemplary embodiment, the header signal conductors 136 are arranged as differential pairs. The header shields 140 are positioned between the differential pairs to provide electrical shielding between adjacent differential pairs.

FIG. 2 is an exploded view of the receptacle connector 102 with the housing 112 removed showing the various components of one of the contact modules 114. Although the description of FIG. 2 relates to the contact modules 114, it should be realized that the contact modules 116 (shown in FIG. 1) may include similar features and may be arranged in a similar manner.

In various embodiments, the contact module 114 includes a holder 152 and a receptacle contact assembly 154 held by the holder 152. The receptacle signal conductors 118 (also shown in FIG. 3) are part of the receptacle contact assembly 154. The receptacle contact assembly 154 includes the leadframe 122 that defines the signal conductors 118 and the dielectric frame 126 that surrounds the leadframe 122. In an exemplary embodiment, the dielectric frame 126 is overmolded over the leadframe 122. The dielectric frame 126 surrounds the leadframe 122 such that the receptacle signal conductors 118 are encased in the dielectric frame 126. The dielectric frame 126 may be formed as a unitary one-piece structure. For example, in the illustrated embodiment, the leadframe 122 is overmolded with dielectric material to form the dielectric frame 126.

In an exemplary embodiment, the leadframe 122 is manufactured using a single stamped and formed sheet of material. In other words, the leadframe 122 is a stamped and formed frame. By manufacturing the leadframe 122 using a single sheet of material, the mating contacts at the mating end of the receptacle signal conductors 118 can be robustly manufactured and provided at a tight spacing or pitch. Additionally, cost savings may be realized by eliminating the need for discrete stamped and formed sheets that are later assembled or joined to create a leadframe. For example, having a single leadframe eliminates the need for two overmolded leadframes that are internested, as with conventional contact assemblies. A unitary leadframe 122 design allows the leadframe to be manufactured without the additional process of joining two or more separate leadframes. A simple and inexpensive receptacle contact assembly 154 is formed in such manner, while still providing high density and robust mating contacts.

In an exemplary embodiment, the holder 152 is a conductive holder 152 that provides electrical shielding for the receptacle contact assembly 154. The holder 152 defines part of the shield structure 130. For example, the holder 152 may be stamped and formed or may be fabricated from a plastic material that has been metalized or coated with a metallic layer. By having the holder 152 fabricated from a conductive material, the holder 152 may provide electrical shielding for the receptacle connector 102.

The shield structure 130 includes a plurality of ground contacts 158, which may be electrically connected to the holder 152 or may be electrically connected to a separate ground shield (not shown). The ground contacts 158 electrically connect the contact modules 114 to the header shields 140 (shown in FIG. 1). The ground contacts 158 provide multiple, redundant points of contact to the header shields 140. The ground contacts 158 provide shielding on all sides of the mating ends of the signal conductors 118.

The holder 152 includes a chamber 160 that receives the receptacle contact assembly 154. The chamber 160 extends between a front 162 and a bottom 164 of the holder 152. The holder 152 includes tabs 166 that divide the chamber 160 into discrete channels 168. The receptacle contact assembly 154 is loaded into the chamber 160 such that the tabs 166 extend through the receptacle contact assembly 154 between different pairs of receptacle signal conductors 118. The tabs 166 define at least a portion of the shield structure of the receptacle connector 102 and provide shielding between the channels 168. The tabs 166 thus provide shielding between the pairs of signal conductors 118 held in the different channels 168. The chamber 160 is configured to receive the receptacle contact assembly 154. For example, the dielectric frame 126 is set in the channels 168 with the tabs 166 extending through portions of the dielectric frame 126.

Figure 3:
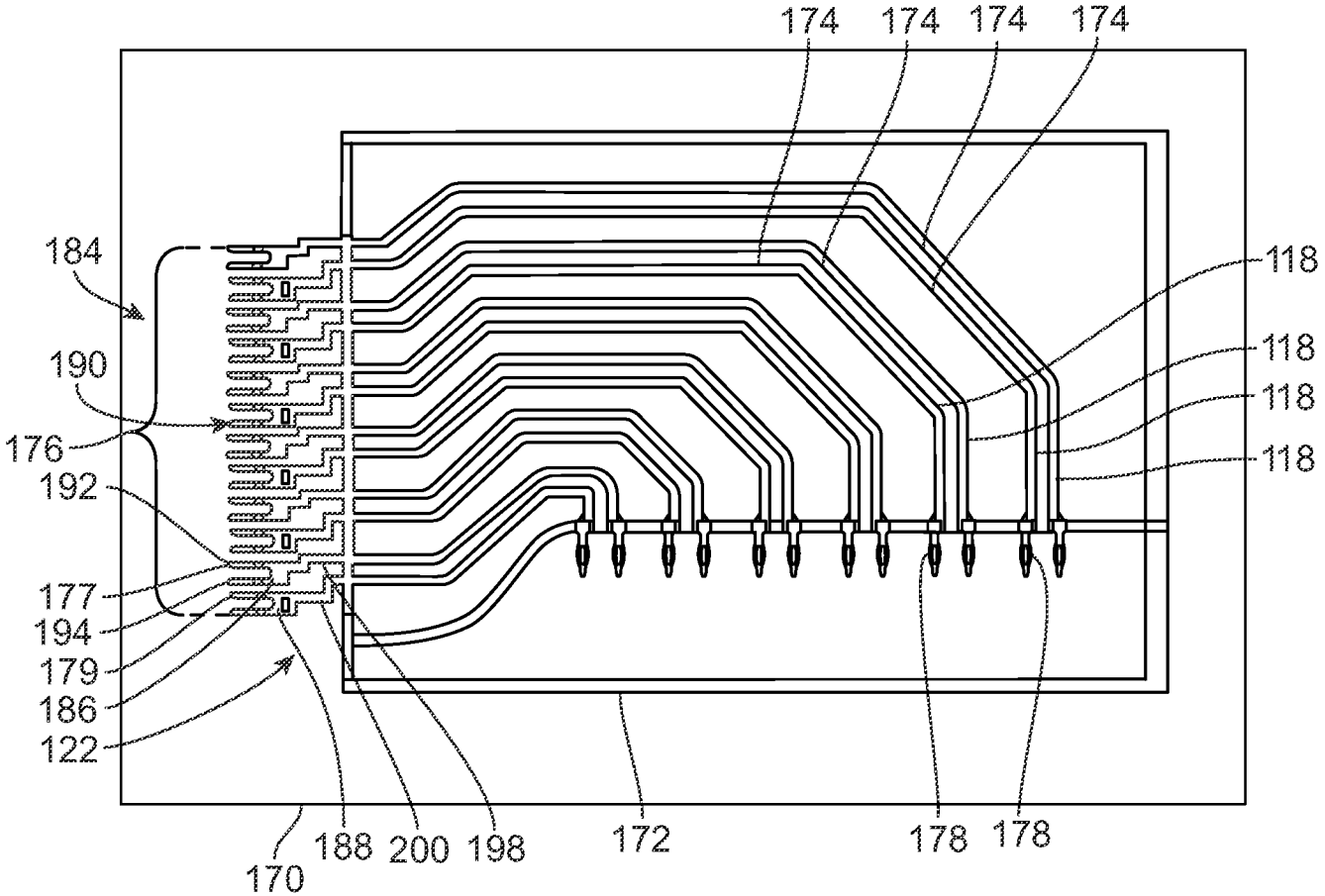
FIG. 3 is a side view of a leadframe in accordance with an embodiment.

FIG. 3 is a side view of the leadframe 122 in accordance with an exemplary embodiment. The leadframe 122 is shown stamped from a blank or sheet of metal material into a predetermined shape prior to forming various portions of the leadframe 122. The leadframe 122 is stamped within a flat receptacle contact plane 170 and may be substantially planar such that there are no out of plane protrusions. The leadframe 122 may be selectively plated, such as in interface areas.

The leadframe 122 is initially stamped with a carrier 172 which is later removed after the dielectric frame 126 (shown in FIG. 2) is overmolded. The carrier 172 initially holds components of the leadframe 122 together. In the illustrated embodiment, the carrier 172 is a contiguous frame peripherally surrounding the receptacle signal conductors 118.

The receptacle signal conductors 118 have transition contacts 174 arranged within the contact plane 170. The transition contacts 174 extend between mating contacts 176 and mounting contacts 178. In the illustrated embodiment, the transition contacts 174 transition 90° between the mating contacts 176 and the mounting contacts 178 such that the mating contacts 176 are generally perpendicular to the mounting contacts 178. Other configurations are possible in alternative embodiments. The transition contacts 174 electrically connect the mating contacts 176 to corresponding mounting contacts 178. The transition contacts 174 are coplanar such that the transition contacts 174 are arranged within the contact plane 170. In the illustrated embodiment, the transition contacts 174 are arranged as differential pairs with all of the receptacle signal conductors 118 of all of the differential pairs being stamped as part of the same leadframe 122. However, in other embodiments, other arrangements are possible.

The mounting contacts 178 are configured to be mated with the circuit board 106 (shown in FIG. 1). In the illustrated embodiment, the mounting contacts 178 are compliant pins, such as eye-of-the-needle pins, that are configured to be press-fit into vias in the circuit board 106. Other types of contacts may be provided in alternative embodiments, such as solder pins, solder tails, solder pads, spring tails and the like. In other embodiments, the mounting contacts 178 may be configured to be terminated to cables rather than the circuit board 106 (shown in FIG. 1), such as by crimping, soldering, or otherwise terminating to the cables.

The mating contacts 176 are configured to be positioned at the mating end 132 (shown in FIG. 1) of the receptacle connector 102. The mating contacts 176 each have one or more mating interfaces 184 configured to be electrically connected to corresponding mating contacts of another connector, such as, for example, the header connector 104 (shown in FIG. 1). In the illustrated embodiment, the mating contacts 176 are configured to be mated with corresponding header signal conductors 120 (shown in FIG. 1) of the header connector 104.

The mating contacts 176 are arranged in pairs. More specifically, each pair of mating contacts 176 includes a first mating contact 177 and a second mating contact 179. In the illustrated embodiment, the mating contacts 177, 179 are split-beam mating contacts each having first and second beams 192 and 194. The first and second beams 192, 194 are configured to engage opposite sides of the corresponding header mating conductor 120. Each of the mating contacts 176 defines a socket 190 configured to receive a respective header signal conductor 120. The first and second beams 192, 194 define multiple points of contact with the header signal conductor 120 to define a reliable electrical connection between the mating contact 176 and the header signal conductor 120.

Each of the mating contacts 176 includes a mating segment and a connecting segment extending between the mating segment and the corresponding receptacle signal conductors 118. More specifically, the first mating contact 177 includes a mating segment 186 and a connecting segment 198. The second mating contact 179 includes a mating segment 188 and a connecting segment 200. The connecting segments 198, 200 are configured to be formed, shaped, bent or otherwise manipulated to position the mating segment 186, 188 in proper position for mating with the header signal conductors 120. For example, the connecting segment 198 may transition the mating segment 177 vertically and/or horizontally relative to the receptacle contact plane 170, as discussed in further detail below.

Figure 4:
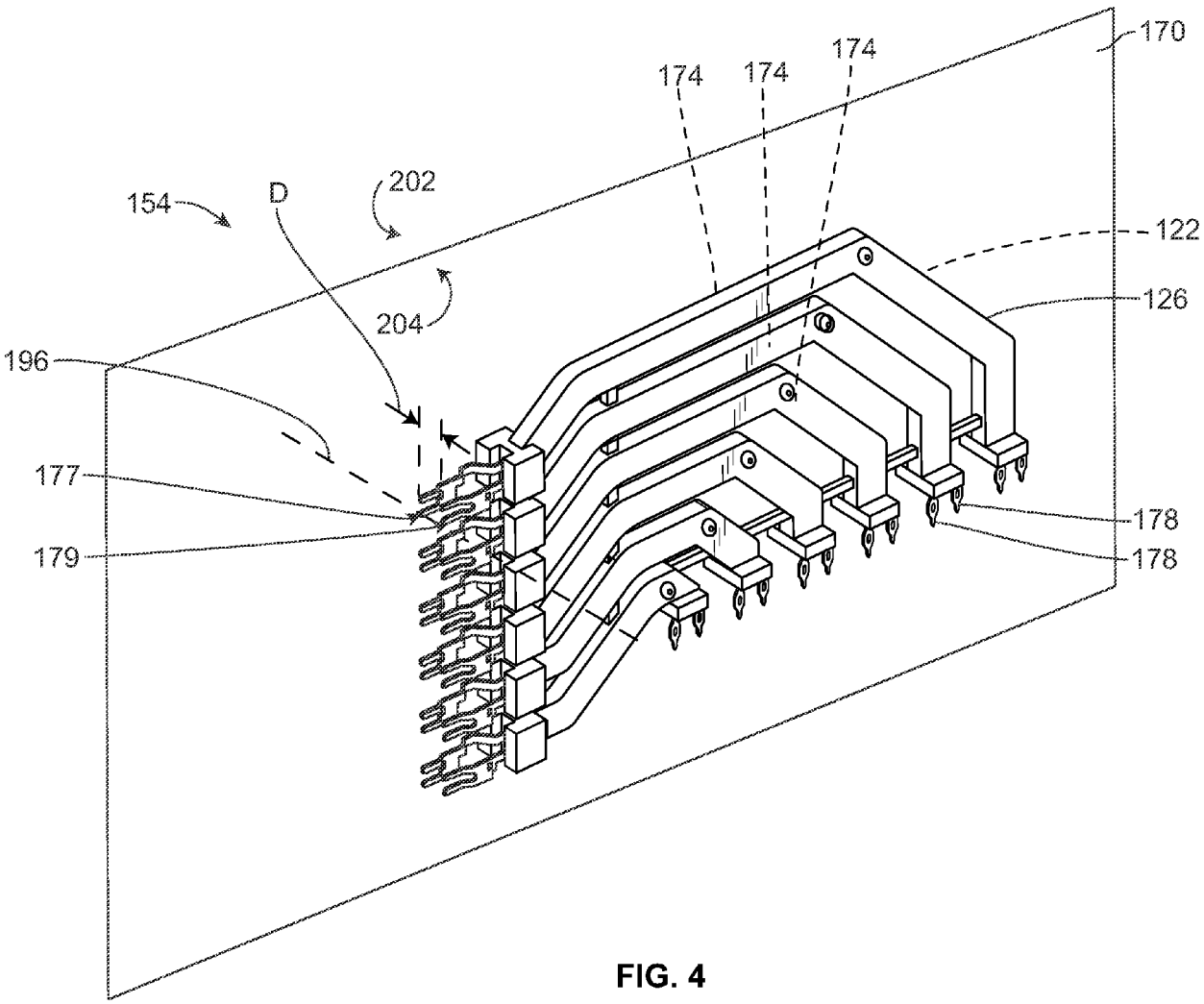
FIG. 4 is a perspective view of a contact assembly, in accordance with an embodiment.

FIG. 4 is a perspective view of the receptacle contact assembly 154. As shown, the leadframe 122 has been encased by the dielectric frame 126. Specifically, at least a portion of the transition contacts 174 (shown in FIG. 3) are overmolded by the dielectric frame 126. However, in other embodiments, the dielectric frame 126 may encase the leadframe 122 without overmolding. The mounting contacts 178 of the signal conductors 118 extend from the dielectric frame 126 for mounting to the circuit board 106 (shown in FIG. 1).

Each pair of first and second mating contacts 177, 179 is aligned in a row along a respective row axis 196. The row axes 196 are generally perpendicular to the receptacle contact plane 170. Optionally, the row axes 196 may be oriented generally horizontally. A distance D may separate the first and second mating contacts 177, 179. The mating contacts 176 of each pair are bent out of the receptacle contact plane 170. For example, the first and second mating contacts 177, 179 are aligned along the row axis 196 on opposite sides of the receptacle contact plane 170. The first mating contact 177 is bent to a first side 202 of the receptacle contact assembly 154 relative to the receptacle contact plane 170. The second mating contact 179 is bent to a second side 204 of the receptacle contact assembly 154 that is opposite of the first side 202. For example, the first mating contact 177 is shifted or jogged to the left of the receptacle contact plane 170 (when viewed from the front) and the second mating contact 179 is shifted or jogged to the right of the receptacle contact plane 170.

Optionally, the first mating contacts 177 of each pair are aligned in a column and the second mating contacts 179 of each pair are aligned in a different column. The first and second mating contacts 177, 179 are associated with different transition contacts 174 and different mounting contacts 178.

Figure 5:
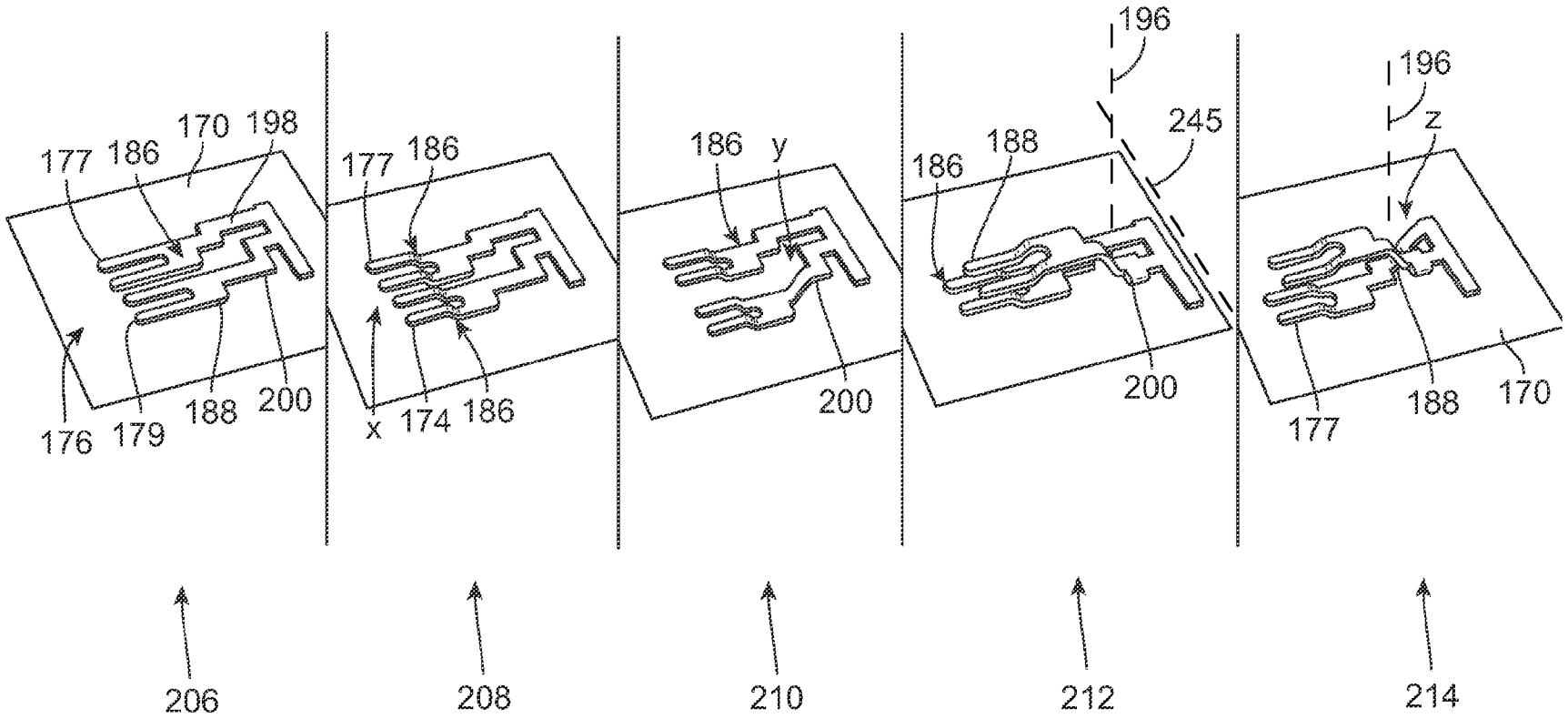
FIG. 5 illustrates a forming process to from mating contacts showing several stages of stamping and forming, in accordance with an embodiment.

FIG. 5 illustrates a forming process to form the mating contacts 176 showing several stages of stamping and forming the mating contacts 176, which are generally identified at 206, 208, 210, 212, and 214.

The process begins with a stamping stage 206. In the stamping stage 206, the first and second mating contacts 177, 179 are stamped as part of the leadframe 122 (shown in FIG. 3) by removing excess material from a sheet of conductive material. The general shapes of the mating segments 186, 188 and the connecting segments 198, 200 are defined for each of the first and second mating contacts 177, 179 during the stamping stage. The first and second mating contacts 177, 179 are coplanar with the receptacle contact plane 170 during the stamping stage.

Next, during a forming stage 208, the mating segments 186, 188 of first and second mating contacts 177, 179, respectively, are partially bent out of the receptacle contact plane 170 in a direction shown by arrow X. Optionally, the mating segments 186, 188 may be double bent, such as in a Z or S shape, such that distal ends of the mating segments are parallel to, but non-coplanar with, the receptacle contact plane 170.

Next, in a further forming stage 210, a jogged portion 211 of the connecting segment 200 is bent or jogged in a direction, shown by arrow Y. For example, the connecting segment 200 is bent toward the second side 204 (shown in FIG. 4) of the receptacle contact assembly 154 (shown in FIG. 4) to transition the connecting segment 200 horizontally. Optionally, the connecting segment 200 may be double bent, such as in a Z or S shape, such that mating segment 186 remains parallel to, but non-coplanar with, the receptacle contact plane 170.

Next, in a further forming stage 212, a portion of the connecting segment 200 is folded 180° such that the mating segments 186, 188 are parallel with respect to one another and aligned along the row axis 196. When folded, the mating segments 188 may be transitioned vertically along a vertical axis 245 that is perpendicular to the row axis 196. Inverting the mating segment 188 allows the mating segment 188 to be aligned with the mating segment 186. The forming stages 208, 210, 212 transition the second mating contact 179 in both a horizontal and a vertical direction.

Next, in a further forming stage 214, the connecting segment 198 of the first mating contact 177 is bent in a direction, shown by arrow Z. For example, the connecting segment 198 is bent toward the first side 202 (shown in FIG. 4) of the receptacle contact assembly 154 (shown in FIG. 4). Optionally, the connecting segment 198 may be double bent, such as in a Z or S shape, such that mating segment 186 remains parallel to, but non-coplanar with, the receptacle contact plane 170. The forming stage 214 transitions the first mating contact 177 in a horizontal direction.

In certain embodiments, at least one of the first mating contact 177 or the second mating contact 179 may be bent out of the contact plane 170 to the first side 202 (shown in FIG. 4) of the leadframe 122 (shown in FIG. 3). For example, the forming process may end at the further forming stage 212 such that the first mating contact 177 is not bent in the Z direction as transitioned in the further forming stage 214. The first mating contact 177 may remain coplanar with the contact plane 170 while only the second mating contact 179 is formed. Alternatively, the second mating contact 179 may remain coplanar with the contact plane 170 while the first mating contact 177 is formed.

Figure 6:
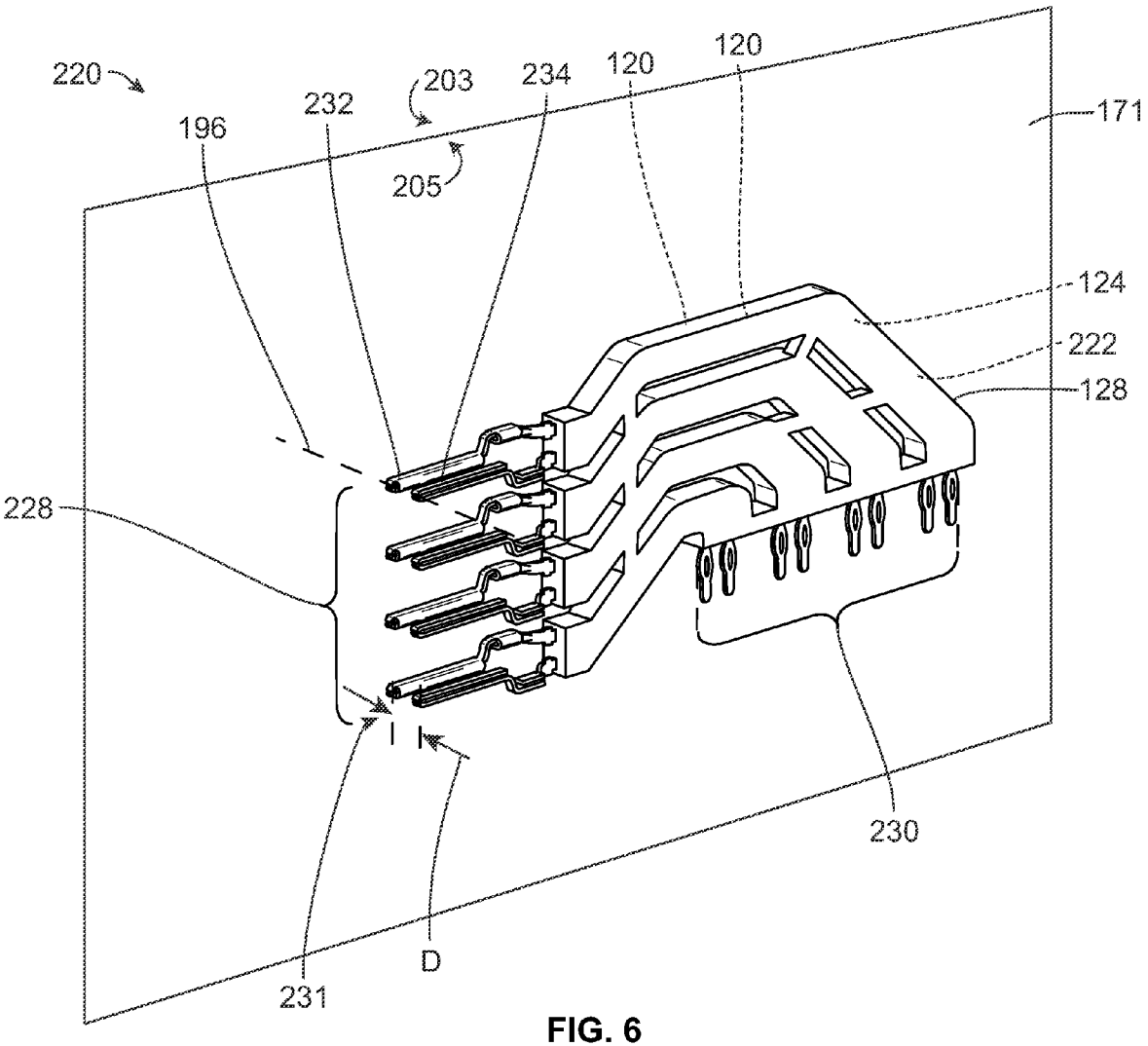
FIG. 6 is a perspective view of a header contact assembly, in accordance with an embodiment.

FIG. 6 is a perspective view of a header contact assembly 220. The header contact assembly 220 may be part of the header contact module 116 (shown in FIG. 1). As discussed in relation to the receptacle contact assembly 154 (shown in FIG. 2), a holder, such as the holder 152 (shown in FIG. 2), may hold the header contact assembly 220 within the header contact module 116. A plurality of header contact assemblies 220 may then form an ensemble and may be held by the housing 112 (shown in FIG. 1) to form the header connector 104 (shown in FIG. 1).

The header contact assembly 220 includes the leadframe 124. The leadframe 124 may be comprise a unitary one-piece structure that is stamped and formed similar to the leadframe 122 of the receptacle connector 102 (shown in FIG. 3). For example, the leadframe 124 may be formed stamped with a carrier (not shown) that may be later removed after the leadframe 124 is stamped and formed. As illustrated, the dielectric frame 128 encapsulates transition contacts 222. The leadframe 124 is stamped within a flat contact plane 171 and may be substantially planar such that there are no out of plane protrusions. The leadframe 124 may be selectively plated, such as in interface areas.

The transition contacts 222 extend between mating contacts 228 and mounting contacts 230. In the illustrated embodiment, the transition contacts 222 transition 90° between the mating contacts 228 and the mounting contacts 230 such that the mating contacts 222 are generally perpendicular to the mounting contacts 230. Other configurations are possible in alternative embodiments. The transition contacts 222 electrically connect the mating contacts 228 to corresponding mounting contacts 230. The transition contacts 222 are coplanar such that the transition contacts 222 are arranged within the contact plane 171. In the illustrated embodiment, the header signal conductors 120 are arranged as differential pairs being stamped as part of the same leadframe 124. However, in other embodiments, other arrangements are possible.

The mounting contacts 230 extend from the transition contacts 222. The leadframe 124 includes the header signal conductors 120 extending between mating contacts 228 and mounting contacts 230. The mounting contacts 230 extend from the signal conductors 120. The mounting contacts 230 are configured to be mated to the circuit board 108 (shown in FIG. 1). In the illustrated embodiment, the mounting contacts 230 are compliant pins, such as eye-of-the-needle pins, that are configured to be press-fit into vias in the circuit board 108. Other types of contacts may be provided in alternative embodiments, such as solder pins, solder tails, solder pads, spring tails and the like. In other embodiments, the mounting contacts 230 may be configured to be terminated to cables rather than to the circuit board 108, such as by crimping, soldering, or otherwise terminating to the cables.

The mating contacts 228 extend forward of the transition contacts 222. The mating contacts 228 each have one or more mating interfaces 231 configured to be electrically connected to another connector, such as, for example, the receptacle connector 102 (shown in FIG. 1). In the illustrated embodiment the mating contacts 228 are configured to be mated with the mating contacts 176 (shown in FIG. 3) of the receptacle connector 102. The mating contacts 228 are arranged in pairs. The mating contacts 228 define a first pin 232 and second pin 234.

Each pair of first and second pins 232, 234 is aligned in a row along a respective row axis 196. The row axes 196 are generally perpendicular to the contact plane 171. Optionally, the row axes 196 may be oriented generally horizontally. A distance E may separate the first and second pins 232, 234. The pins 232, 234 of each pair are bent out of the contact plane 171. For example, the first and second pins 232, 234 are aligned along the row axis 196 on opposite sides of the contact plane 171. The first pin 232 is bent to a first side 203 of the header contact assembly 220 relative to the contact plane 171. The second pin 224 is bent to a second side 205 that is opposite of the first side 203. For example, the first pin 232 is shifted or jogged to the left of the contact plane 171 (when viewed from the front) and the second pin 234 is shifted or jogged to the right of the contact plane 171. Optionally, the first pins 232 of each leadframe 124 are aligned in a first column and the second pins 234 of each leadframe 124 are aligned in a second column. The first and second pins 232, 234 are associated with different header signal conductors 120 and different mounting contacts 230.

Figure 7:
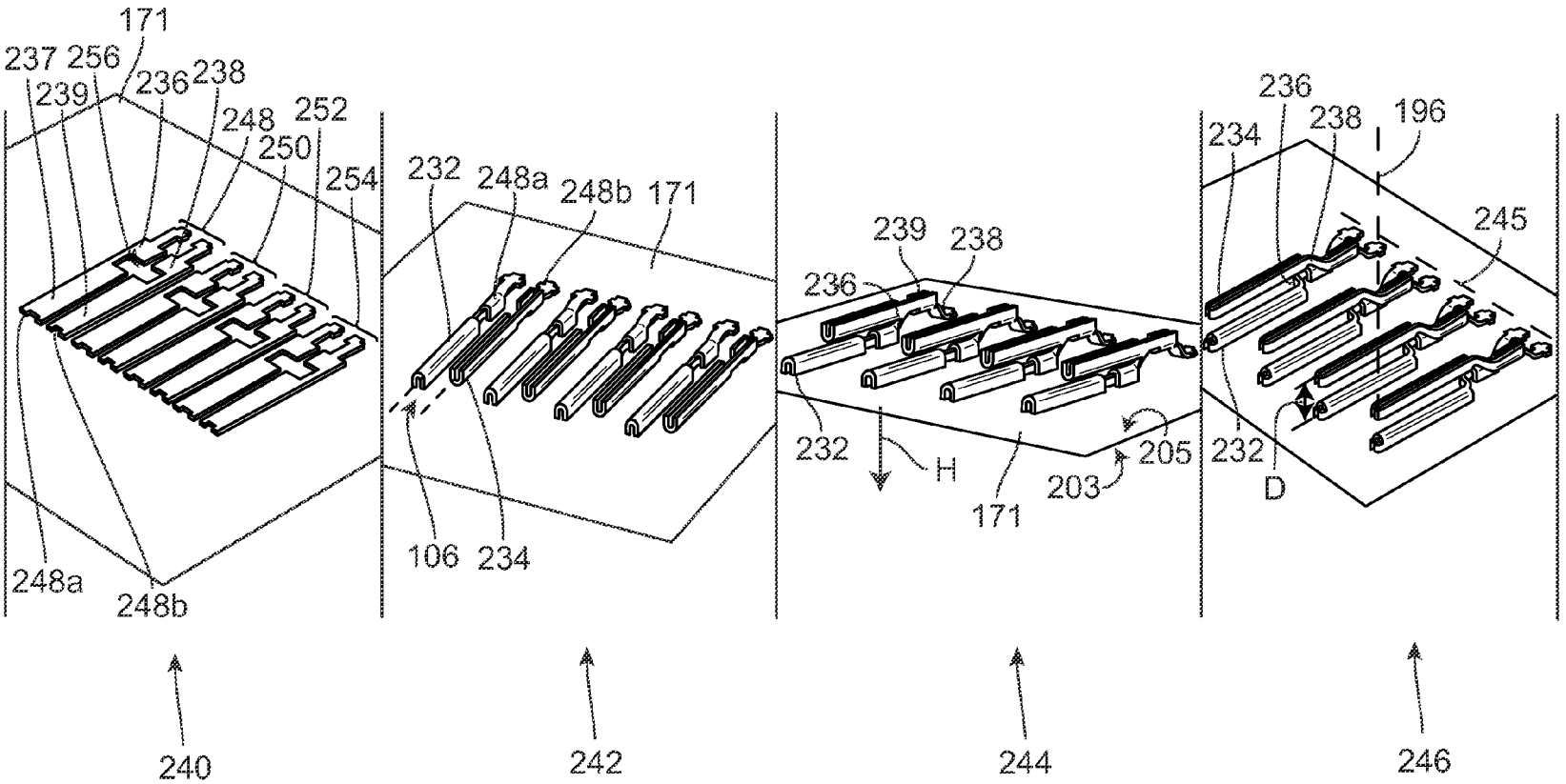
FIG. 7 illustrates another forming process to from mating contacts showing several stages of stamping and forming in accordance with an embodiment.

FIG. 7 illustrates a forming process to form the mating contacts 228 shown in FIG. 6 showing several stages of stamping and forming, which are generally identified at 240, 242, 244, and 246.

The process begins with a stamping stage 240. In the stamping stage 240, a plurality of interface blank sets 248, 250, 252, and 254 are stamped from one or more sheets of conductive material, such as a metal material. The general shape of the interface blank sets 248-254 may be defined during the stamping stage 240. The interface blank sets 248-254 are coplanar with the contact plane 171 during the stamping stage 240. The interface blank sets 248-254 each have a first end 255 and a second end 257. The first end 255 of each of the interface blank sets 248-254 attaches to the transition contacts 222 (shown in FIG. 6). The second end 257 of each of the interface blank sets 248-254 is configured to be mated with a corresponding header signal conductor 120 (shown in FIG. 1). The interface blanks sets 248-254 may include complementary pairs. For example, interface blanks 248*a* and 248*b* may be complementary such that the interface blank 248*a* is a mirror image of the interface blank 248*b*. Each of the interface blank sets 248-254 may include a windowed region 256 separating the connecting segment 236, 238 and first and second contact portions 237, 239, respectively. The first and second contact portions 237, 239 may also be referred to herein as mating segments. The windowed region 256 creates a stamped portion 259 that allows first and second contact portions 237, 239 to be manipulated or transitioned relative to the connecting segment 236, 238, as discussed below in relation to the further forming state 246.

Next, in a forming stage 242, the first and second contact portions 237, 239 are bent to create the first and second pins 232, 234, respectively. The interface blank 248*a* is rolled along the length of the blank 248*a*. In other words, the interface blank 248*a* is bent substantially 180° to form a U-shape that is open downwardly with respect to the contact plane 171 to define the shape of the first pin 232. Similarly, the interface blank 248*b* is rolled 180° along the length of the blank 248*b* to form a U-shape that is open upwardly to define the shape of the second pin 234. In this fashion, the first and second contact portions 237, 239 form the pins 232, 234.

Next, in a further forming stage 244, the connecting segment 236 of the blank 248*a* is bent in a first direction shown by the arrow H, and the connecting segment 238 of the blank 248*b* is bent in an opposite direction. As shown, the arrow H is substantially perpendicular to the contact plane 171. As such, the connecting segments 236, 238 translate the pins 232, 234, horizontally. For example, the connecting segment 236 translates the blank 238*a* toward the first side 203 of the contact plane 171, and the connecting segment translates the blank 238*b* toward the second side 205 of the contact plane 171. Optionally the connecting segments 236, 238 may be double bent in a Z or S shape, such that the pins 232, 234 are parallel to, but non-coplanar with, the contact plane 171.

Next, in a further forming stage 246, the connecting segments 236, 238 are transitioned vertically along the vertical axis 245 such that the pins 232, 234 are parallel with respect to one another and are aligned along the row axis 196. After being bent, the pins 232, 234 may be separated by a distance F.

Figure 8:
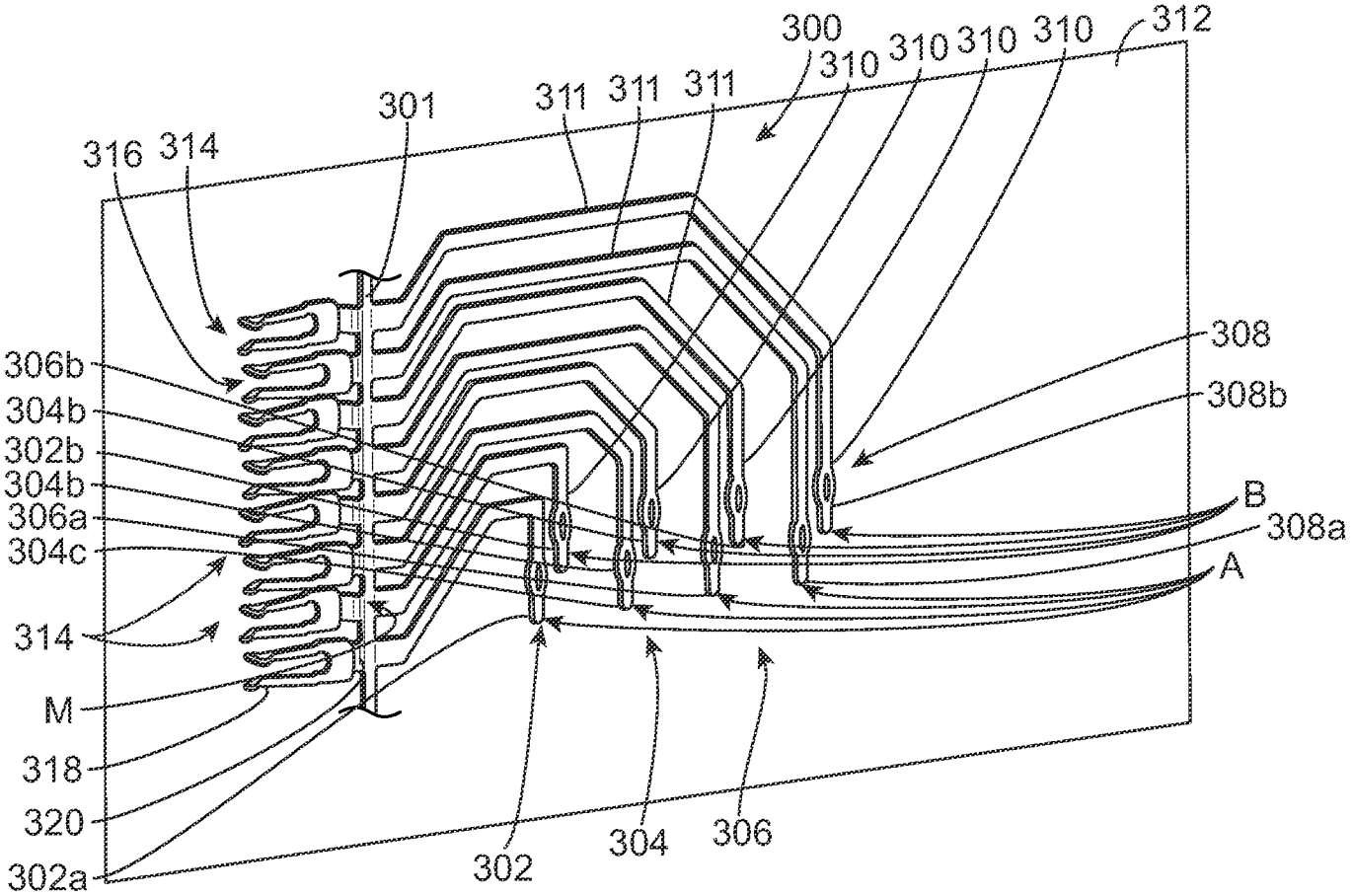
FIG. 8 is a perspective view of a single strip leadframe in accordance with an embodiment.

FIG. 8 is an exemplary embodiment of a single strip leadframe 300 in accordance with an exemplary embodiment. Optionally, in various embodiments, the single strip leadframe 300 may be used in place of the leadframe 122 shown in FIG. 3. The single strip leadframe 300 may be used in a receptacle connector, such as the receptacle connector 102 (shown in FIG. 1). In various embodiments, a single strip leadframe may also be used in the header connector 104 (shown in FIG. 1). The single strip leadframe 300 may be manufactured using a stamped and formed sheet of material.

The single strip leadframe 300 includes one or more pairs of signal conductors 302, 304, 306, 308 held by a common carrier 301. In the illustrated embodiment, the single strip leadframe 300 includes pairs of signal conductors 302*a* and 302*b*, 304*a* and 304*b*, 306*a* and 306*b*, and 308*a* and 308*b*. Each of the signal conductors 302-308 include transition contacts 311 extending between respective mating contacts 314 and mounting contacts 310. The signal conductors 302-308 are vertically offset from one another along a vertical axis 303 of the common carrier 301. The signal conductors 302-308 may be vertically offset such that each of the mating contacts 314 are arranged along the vertical axis 303. The transition contacts 311 are arranged in a contact plane 312 such that the transition contacts 311 are coplanar.

The signal conductors 302-308 in each pair may be substantially similar to one another in size and shape. For example, the signal conductor 302*a* may be substantially similar in size and shape to the signal conductor 302*b*. The signal conductors 302-308 in each pair have a common length. For example, the signal conductors 302*a* and 302*b* may have a substantially similar length from the mating contact 314, to and through the transition contact 311, and to the mounting contact 310 of each respective signal conductor 302*a* and 302*b*.

The signal conductors 302-308 terminate to respective mounting contacts 310. The mounting contacts 310 may terminate to the circuit board 106 (shown in FIG. 1). In the illustrated embodiment, the mounting contacts 310 are compliant pins, such as eye-of-the-needle pins, that are configured to be press-fit into vias in the circuit board 106. Other types of contacts may be provided in alternative embodiments, such as solder pins, solder tails, solder pads, spring tails and the like. In other embodiments, the mounting contacts 310 may be configured to be terminated to cables rather than to the circuit board 106, such as by crimping, soldering, or otherwise terminating to the cables.

The signal conductors 302-308 include the mating contacts 314. Unlike the signal conductors 118 (shown in FIG. 3) of the leadframe 122 (shown in FIG. 3), the signal conductors 302-308 of the single strip leadframe 300 include mating contacts 314 that are pre-formed. For example, the mating contacts 314 are not bent 180° as described in the mating and forming process discussed in relation to FIG. 5. Instead, the mating contacts 314 are configured to be aligned using a dielectric holder 324 (shown in FIG. 9) as discussed below. The mating contacts 314 extend forward of the transition contacts 311 toward the mating end 132 (shown in FIG. 1). The mating contacts 314 of each respective signal conductors 302-308 is vertically staggered along the vertical axis 303. The mating contacts 314 each have one or more mating interfaces 316 configured to be electrically connected to corresponding mating contacts of another connector, such as, for example, the header connector 104 (shown in FIG. 1). In the illustrated embodiment, the mating contacts 314 are configured to be mated with corresponding header signal conductors 120 (shown in FIG. 1) of the header connector 104.

Each of the mating contacts 314 include a mating segment 318 and a connecting segment 320. The connecting segment 320 transitions each of the signal conductors 302-308 to the transition contacts 311, such as to shift the respective mating segment 318 to one side or the other of the contact plane 312. The connecting segments 320 of signal conductors 302*a*, 304*a*, 306*a*, and 308*a* (hereinafter the "A set") are bent in a first direction M to a first side relative to the contact plane 312. The connecting segments 320 of the signal conductors 302*b*, 304*b*, 306*b*, and 308*b* (hereinafter the "B set") are bent to a second side that is opposite to the first side relative to the contact plane 312. For example, the A set may be bent to the left of the contact plane 312, when viewed from the front, and the B set may be bent to the right of the contact plane 312.

Figure 9:
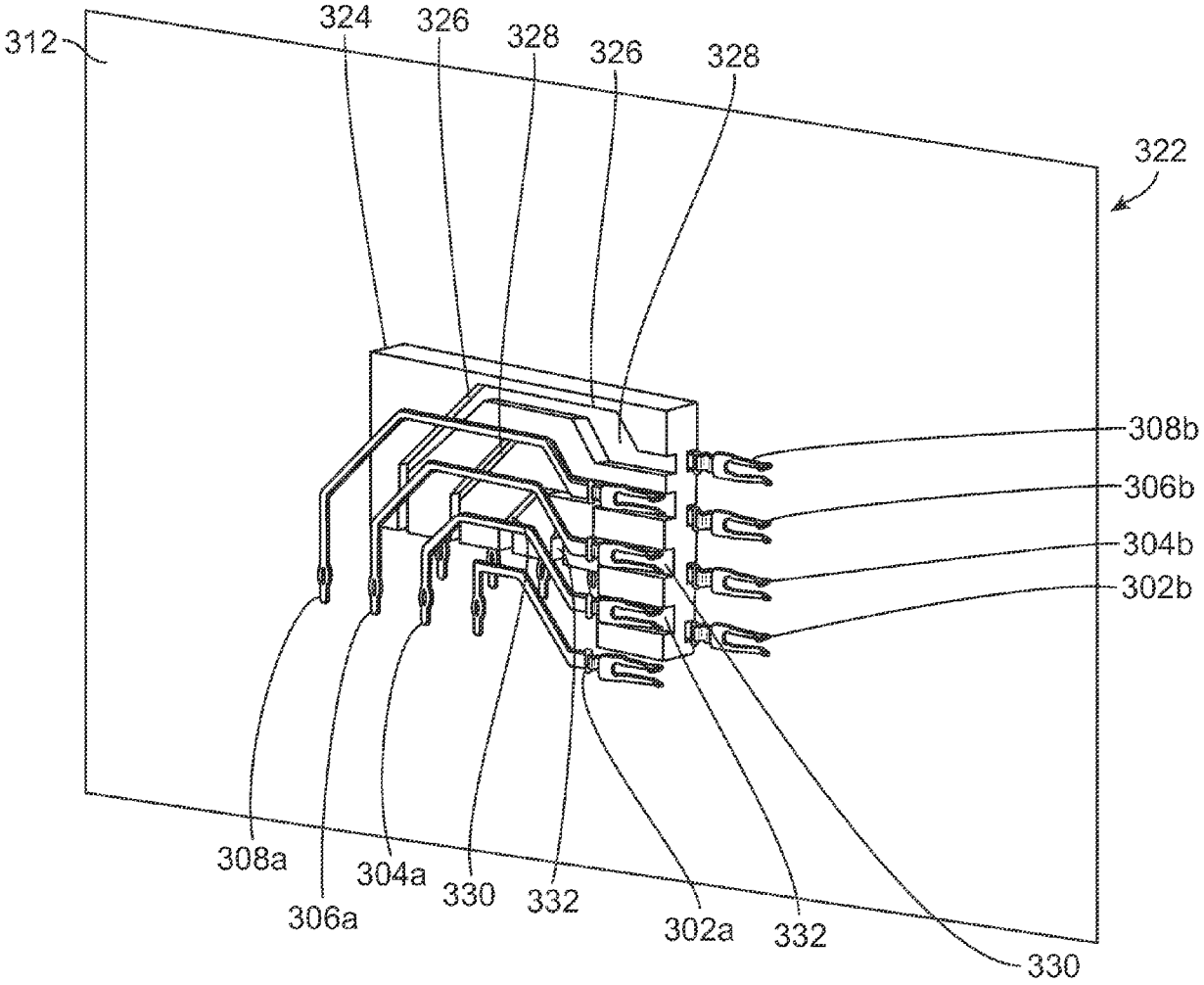
FIG. 9 is a perspective view of a single strip leadframe assembly in accordance with an embodiment.

FIG. 9 is a perspective view of a single strip leadframe assembly 322 in accordance with an exemplary embodiment. The leadframe assembly 322 includes the signal conductors 302-308 removed from the single strip leadframe 300 (shown in FIG. 8). For example, as illustrated, the carrier 301 (shown in FIG. 8) has been removed from the single strip leadframe 300, thereby singulating each of the signal conductors 302-308.

The leadframe assembly 322 also includes the dielectric holder 324 configured to hold the signal conductors 302-308. The dielectric holder 324 is made of an insulative material to electrically isolate the signal conductors 302-308 from one another. For example, the dielectric holder 324 may be made of a plastic material. The dielectric holder 324 may be premolded and is configured to receive the signal conductors 302-308. The dielectric holder 324 includes channels 326, 328, 330, and 332 that are dimensioned (for example, sized and shaped) to receive the A set of signal conductors 302-308. The channel 326 is dimensioned to receive the signal conductor 308*a*, the channel 328 is dimensioned to receive the signal conductor 306*a*, the channel 330 is dimensioned to receive the signal conductor 304*a*, and the channel 332 is dimensioned to receive the signal conductor 302*a*. The channels 326-332 extend along respective paths from a front 334 of the dielectric holder 324 to a bottom 336 of the dielectric holder 324. The channels 326-332 extend parallel to the contact plane 312. The dielectric holder 324 may include corresponding channels 340, 342, 344, and 346 on a second, opposite side 350 configured to receive the B set of signal conductors. The channels 340-346 correspond to the channels 326-332 such that the channels on both sides of the dielectric holder 324 are aligned with one another. Accordingly, when the signal conductors 302-308 are held in respective channels, the mating contacts 314 of each signal conductor 302-308 are horizontally aligned. For example, when the signal conductor 302*a* is held in the channel 332 and signal conductor 302*b* is held in channel 346, the mating contact 314 of the signal conductor 302*a* is horizontally aligned with the mating contact 314 of the signal conductor 302*b*.

Because the A set and the B set of signal conductors 302-308 are similar or identical to one another, when the signal conductors 302-308 are held in the dielectric holder 324, the A and B sets of signal conductors 302-308 extend along similar paths. The A and B sets of signal conductors 302-308 may be pairs configured to carry differential signals. For example, the signal conductors 302*a* and 302*b* may define a differential pair and may be skewless because the signal conductors 302*a* and 302*b* have similar path lengths.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

What is claimed is:

1. An electrical connector comprising:

a contact module including a single leadframe and a single dielectric frame surrounding the leadframe;

the leadframe having signal conductors, the signal conductors having transition contacts encased in the dielectric frame, the transition contacts being coplanar such that the transition contacts are arranged within a contact plane of the leadframe, the signal conductors having mating contacts extending from the corresponding transition contacts, each of the mating contacts having a mating interface configured to be electrically connected to a corresponding mating contact of a mating connector, the mating contacts being arranged in pairs with the corresponding mating interfaces aligned in rows along corresponding row axes, each of the pairs of mating contacts being arranged in different rows at different vertical positions.

2. The electrical connector of claim 1, wherein one mating contact of each pair is bent out of the contact plane to a first side of the leadframe and the other mating contact of the pair is bent out of the contact plane in to a different side of the leadframe.

3. The electrical connector of claim 1, wherein the row axes are oriented horizontally, at least some of the mating contacts being bent vertically along a vertical axis to align the mating interfaces of the mating contacts within each pair.

4. The electrical connector of claim 3, wherein the mating contacts within each pair are bent in opposite directions along the vertical axis.

5. The electrical connector of claim 1, wherein the mating contacts of each pair are aligned along the row axis on opposite sides of the contact plane.

6. The electrical connector of claim 1, wherein at least a portion of the transition contacts are overmolded by the dielectric frame.

7. The electrical connector of claim 1, wherein the signal conductors include mounting contacts extending from the dielectric frame for termination to a circuit board, the transition contacts electrically connecting the mounting contacts to the corresponding mating contacts.

8. The electrical connector of claim 1, wherein the dielectric frame comprises a unitary one piece dielectric body.

9. The electrical connector of claim 1, wherein the leadframe is a stamped and formed frame.

10. The electrical connector of claim 1, wherein the mating contacts each include a mating segment and a connecting segment extending between the mating segment and the corresponding transition contacts, the connecting segment transitioning the mating segment both horizontally and vertically relative to the contact plane.

11. The electrical connector of claim 10, wherein the connecting segment includes at least one stamped portion transitioning the mating segment vertically.

12. The electrical connector of claim 10, wherein the connecting segment includes at least one jogged portion transitioning the mating segment horizontally.

13. The electrical connector of claim 1, wherein the transition contacts are initially held together by a common carrier, which is later removed.

14. The electrical connector of claim 1, wherein the signal conductors are arranged as differential pairs.

15. The electrical connector of claim 1, wherein one mating contact of each pair is bent out of the contact plane to a first side of the leadframe.

16. An electrical connector comprising:

a contact module including a stamped and formed leadframe and a unitary one piece dielectric frame surrounding a portion of the leadframe;

the leadframe having signal conductors, the signal conductors having transition contacts encased in the dielectric frame, the transition contacts being coplanar such that the transition contacts are arranged within a contact plane of the leadframe, the signal conductors having mating contacts extending from the corresponding transition contacts, each of the mating contacts having a mating interface configured to be electrically connected to a corresponding mating contact of a mating connector, the mating contacts being arranged in pairs with the corresponding mating interfaces aligned in rows along corresponding row axes, each of the pairs of mating contacts being arranged in different rows at different vertical positions.

17. The electrical connector of claim 16, wherein the mating contacts are rolled to form a pin connector.

18. The electrical connector of claim 16, wherein one mating contact of each pair is bent out of the contact plane to a first side of the leadframe and the other mating contact of the pair is bent out of the contact plane in to a different side of the leadframe.

19. An electrical connector comprising:

a contact module including a single strip leadframe having one or more pairs of signal conductors held by a common carrier, the signal conductors in each pair have a common length, each of signal conductors being vertically offset along a vertical axis of the common carrier;

the signal conductors having transition contacts that are coplanar such that the transition contacts are arranged within a contact plane of the single strip leadframe, the signal conductors having mating contacts extending from corresponding transition contacts, each of the mating contacts having a mating interface configured to be electrically connected to a corresponding mating contact of a mating connector, the mating contacts of each pair of signal conductors being vertically staggered along the vertical axis.

20. The electrical connector of claim 17, wherein the signal conductors are removed from the common carrier and are held by a dielectric holder such that the mating contacts of each pair of transition contacts are horizontally aligned.

* * * * *